US006098875A

United States Patent [19]

Cheng et al.

[11] Patent Number: 6,098,875

[45] Date of Patent: Aug. 8, 2000

[54] STRUCTURE OF A COIN COLLECTOR COVER

[76] Inventors: Li-Der Cheng, 6F, No. 8, Lane 82, Sec. 7, Chung Shan N. Rd., Taipei; Yi-Rong Lee, 7F, No. 382, Hsin Feng Street, Keelung, both of Taiwan

[21] Appl. No.: 09/321,705

[22] Filed: May 28, 1999

[51] Int. Cl.[7] ..... G07B 15/00

[52] U.S. Cl. ..... 232/15; 232/16; 379/145; 379/437; 379/451

[58] Field of Search ..... 232/15, 16, 4 R, 232/7, 1 D, 12, 55; 379/145, 143, 445, 437, 451, 453; 70/DIG. 72; 194/350

[56] References Cited

U.S. PATENT DOCUMENTS

| | | | |
|---|---|---|---|
| 1,964,528 | 6/1934 | Mills | 232/15 |
| 1,984,037 | 12/1934 | Shann | 232/15 |
| 2,009,085 | 7/1935 | Jackson | 232/15 |
| 2,052,322 | 8/1936 | Terry | 232/15 |
| 2,096,476 | 10/1937 | Veale | 232/15 |
| 2,172,554 | 9/1939 | Veale | 232/15 |
| 3,837,566 | 9/1974 | McGough | 232/15 |
| 5,038,908 | 8/1991 | McGough | 232/15 X |
| 5,802,172 | 9/1998 | Ingalsbe et al. . | |

*Primary Examiner*—Terry Lee Melius
*Assistant Examiner*—William L. Miller

[57] ABSTRACT

An improved structure of a coin collector cover comprises an upper cover, a cover plate, a buckling piece, a positioning plate and a twisted spring. The upper cover is installed with a coin inlet and a slot. The cover plate is located on the plane of the upper cover. A plurality of teeth are installed on the edge thereof, and a twisted spring is arranged between the cover plate and the upper cover. By the elastic force of the twisted spring, the cover plate may be retained to cover the coin inlet. The buckling piece is pivotally installed on the plane of the upper cover. The edge thereof is installed with a plurality of teeth pieces for being engaged with the teeth of the cover plate. A nose portion is disposed at the edge thereof, while the buckling piece is further installed with a block which is combined with a lock. The edge of the positioning plate is formed with a concave portion for receiving the buckling piece so that the positioning plate can be installed on the plane of the upper cover. A compressible spring is formed between the positioning plate and the upper cover. By the elastic force of the compressible spring, the concave portion of the compressible spring may move toward the nose portion of the buckling piece. By above structure, when the covers plate cover the coin inlet, the lock is controllable so that the teeth piece is engaged with the teeth of the cover plate and then the concave portion of the positioning plate is engaged with the nose portion of the buckling piece so as to avoid the cover plate being opened, when the lock is controlled to cause the buckling piece to displace so that the teeth piece separates from the teeth of the cover plate, then the cover plate may be opened and the coin inlet appears.

3 Claims, 9 Drawing Sheets

STRUCTURE OF A COIN COLLECTOR COVER

FIELD OF THE INVENTION

The present invention relates to an improved structure of a coin collector cover, and especially to a coin collector cover with a stronger structure prevented from being destroyed.

BACKGROUND OF THE INVENTION

The prior art payphone is arranged with a coin collector in the lower end thereof. When a user throws a coin into the payphone, the coin passes through a specific channel to contact a wire and then drop into the coin collector cover.

Conventionally, in consideration of safety, often the coin collector can not be opened by those collecting the coin collector they must take the coin collector to the office of the telephone company, then persons with the privilege to open the coin collector will open the coin collector. In other words, the conventional coin collector of a payphone has two lock channels, one for locking the coin collector to the payphone, the other for opening the coin inlet and installed coin collector cover of the coin collector.

As shown in FIG. 7, in the prior art coin collector cover of the coin collector (not shown) in a payphone, a coin inlet A1 is installed above the upper cover A. Moreover, a cover plate B for shielding the coin inlet A1 is installed in the plane of the upper cover A. The edge of the cover plate B is installed with a plurality of stepped portions B1. A positioning plate D and a fixing plate E are pivotally installed at different positions in the plane of the upper cover A. A spring F is disposed between the fixing plate and the cover plate B. By the elastic force of the spring F, the cover plate B may be retained to cover the coin inlet A1. The edge of the positioning plate D has a concave portion D1. In the same plane of the upper cover A is arranged a lock C. The lock center of the lock C is combined with a hook C1. Thereby, as the cover plate B shields the coin inlet A1, the lock C is controlled to be locked so that the hook will lock the stepped portion B1 of the of the cover plate B so as to fix the cover plate B in order to avoid the cover plate B being opened for stealing money. When the lock C is opened so that the hook C1 completely separates from the stepped portion B1, the hook C may be engaged with the concave portion D1 of the positioning plate D so as to fix the hook C1 (as shown in FIG. 8). Therefore, the cover plate B can be opened, and the coin inlet A1 appears (as shown in FIG. 9) for taking out the coins. However, since in the structure of the conventional structure of the coin collector cover, the hook C1 of the lock is very near the coin inlet, and the buckling force between the hook C1 and the stepped portion B1 of the cover plate B is weak, thus it is easily destroyed by inserting a slender strip into the coin inlet to destroy the hook, and then opening the cover plate B to steal the coins. Therefore, it is eagerly desired to have a novel design for improving the aforementioned defects.

SUMMARY OF THE INVENTION

Accordingly, the primary object of the present invention is to provide an improved structure of a coin collector cover comprising an upper cover, a cover plate, a buckling piece, a positioning plate and a twisted spring. The upper cover is installed with a coin inlet and a slot. The cover plate is located in the plane of the upper cover. A plurality of teeth are installed on the edge thereof, and a twisted spring is arranged between the cover plate and the upper cover. By the elastic force of the twisted spring, the cover plate may be retained to cover the coin inlet. The buckling piece is pivotally installed in the plane of the upper cover. The edge thereof is installed with a plurality of teeth pieces for engaging with the teeth of the cover plate. A nose portion is disposed at the edge thereof, while the buckling piece is further installed with a block which is combined with a lock. The edge of the positioning plate is formed with a concave portion for receiving the buckling piece so that the positioning plate can be installed on the plane of the upper cover. A compressible spring is formed between the positioning plate and the upper cover. By the elastic force of the compressible spring, the concave portion of the compressible spring may move toward the nose portion of the buckling piece. By above structure, when the cover plate covers the coin inlet, the lock is controllable so that the teeth piece is engaged with the teeth of the cover plate and then the concave portion of the positioning plate is engaged with the nose portion of the buckling piece so as to avoid the cover plate to be opened, when the lock is controlled to cause the buckling piece to displace so that the teeth piece separates from the teeth of the cover plate, then the cover plate may be opened and the coin inlet appears.

The various objects and advantages of the present invention will be more readily understood from the following detailed description when read in conjunction with the appended drawing.

DETAILED DESCRIPTION OF THE PREFERRED EMBODIMENTS

Figure 1:
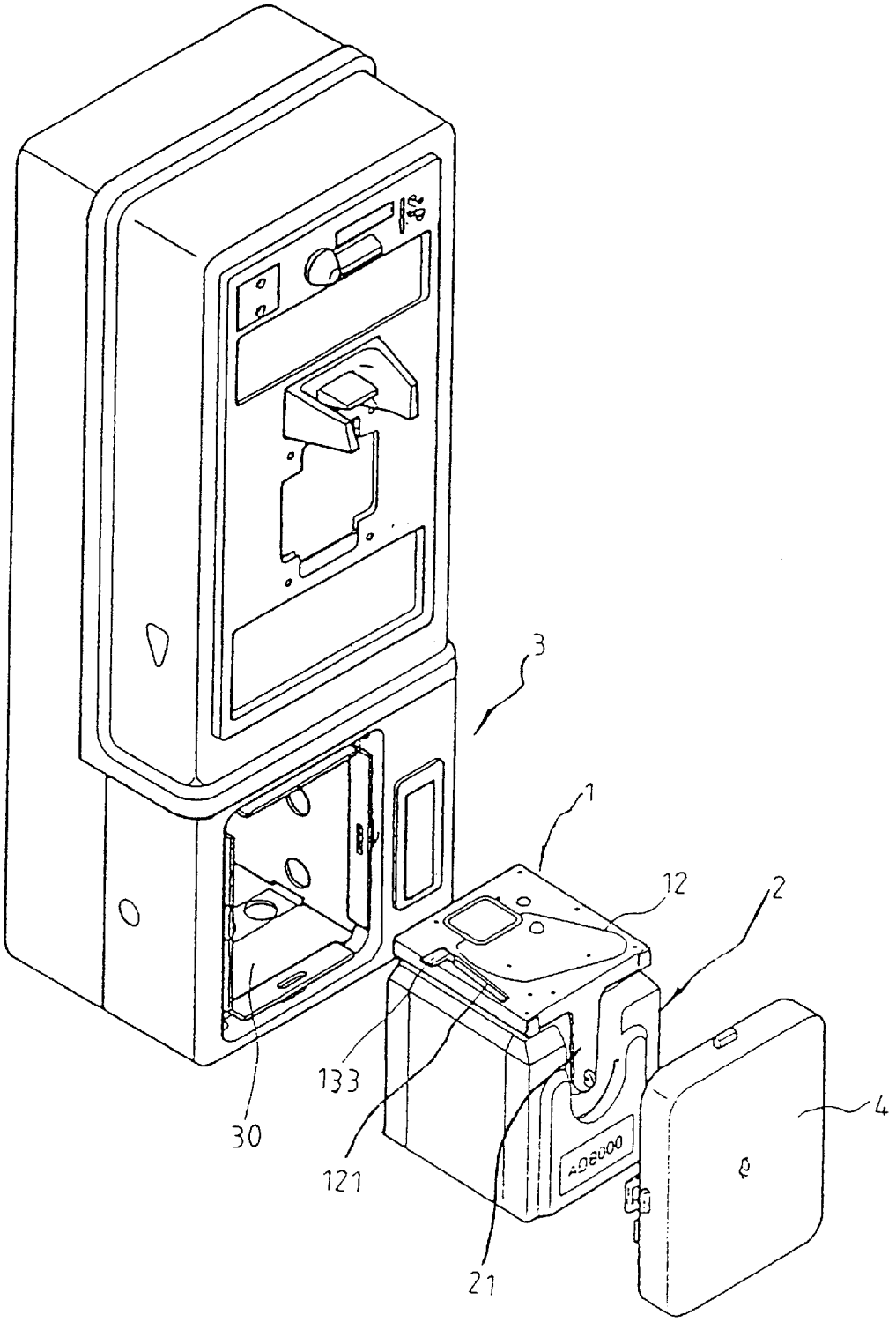
FIG. 1 is an exploded perspective view showing the coin collector cover of the present invention is installed to a coin collector and then the coin collector is further assembled to a payphone.

Referring to FIG. 1, the coin collector cover according to the present invention is illustrated. A coin collector cover 11 is arranged above the coin collector 2. A lock 2 is installed in the coin collector 2. Thereby, the coin collector 2 can be received within the coin collector cavity 30 of the telephone body 3. A panel 4 covers the rear side of the coin collector hole 30 so that the lock 21 will lock the panel 4 to be fixed. When the coin collector 2 is desired to be taken out 2, the lock 21 is opened so to detach the panel 4 and thus the coin collector can be taken out.

Figure 2:
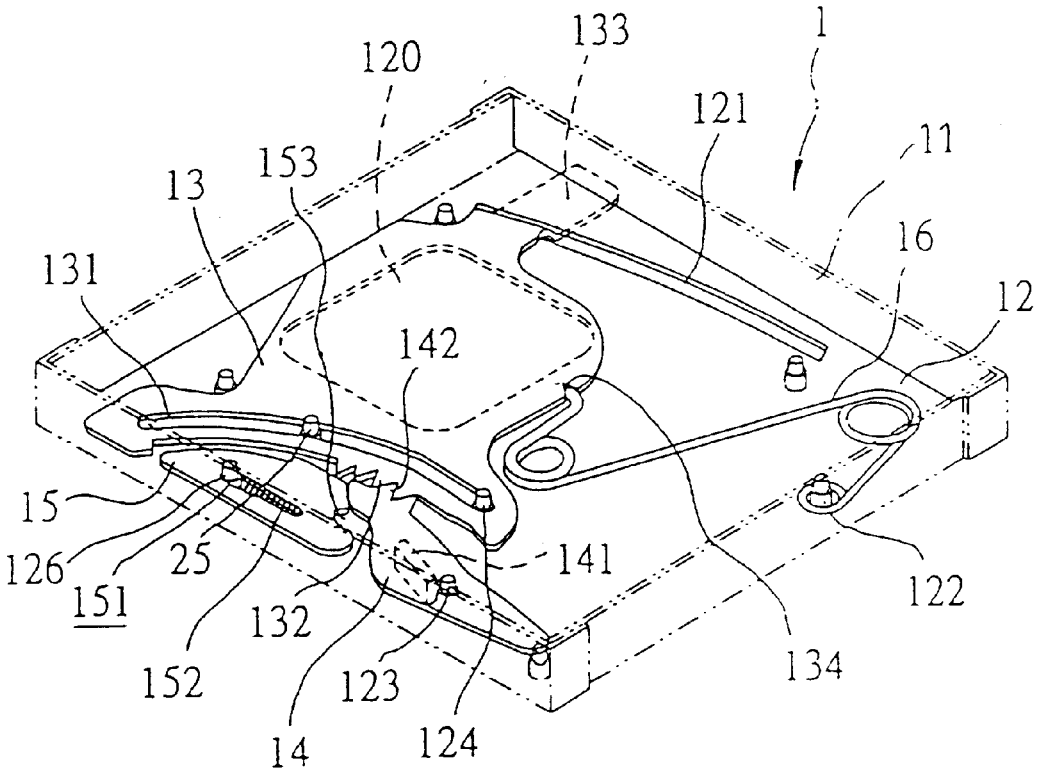
FIG. 2 is a perspective view showing the structure of the coin collector cover of the present invention.
Figure 3:
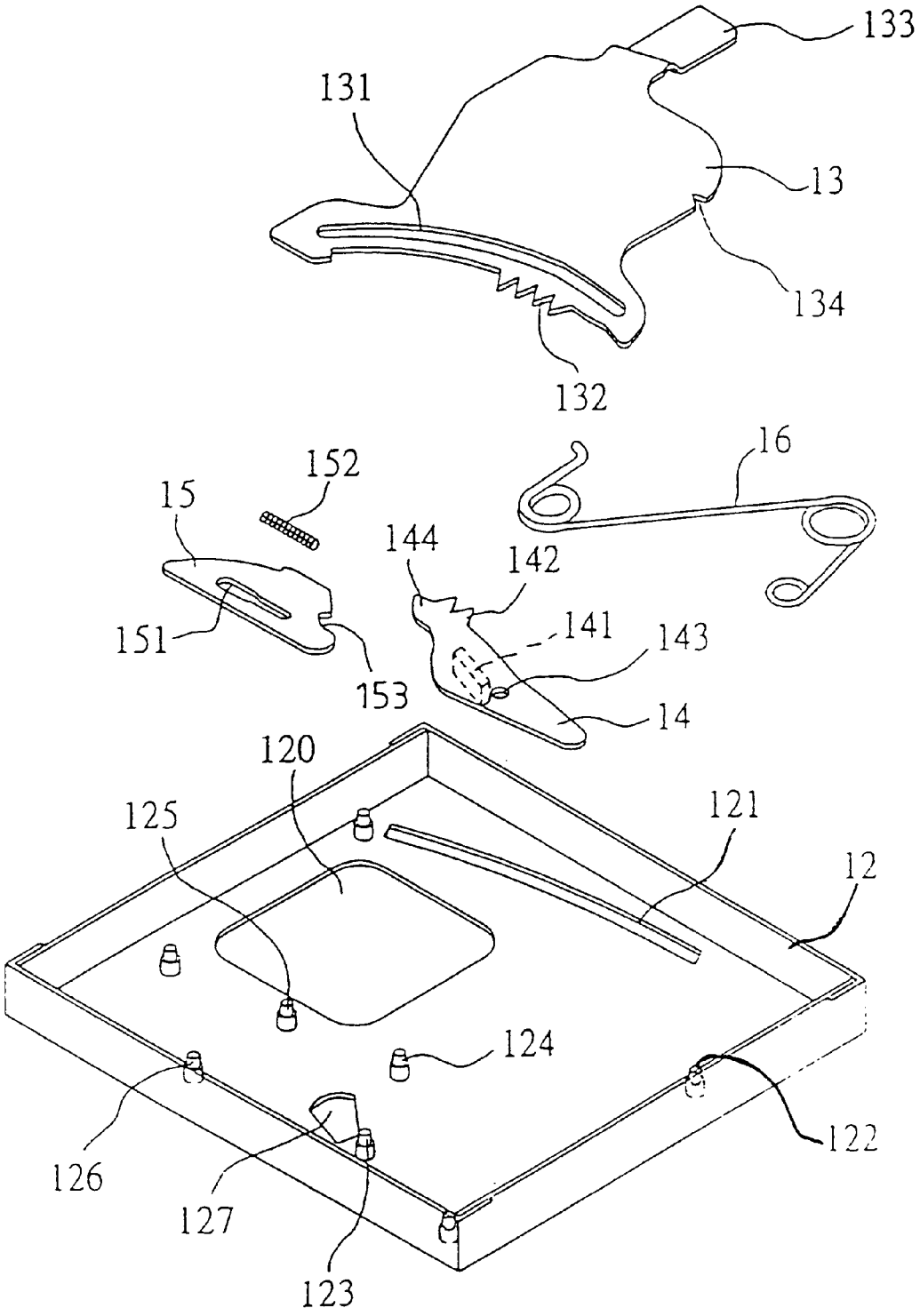
FIG. 3 is an exploded perspective view of the coin collector cover structure of the present invention.

With reference to FIGS. 2 and 3, the coin collector cover structure of the present invention includes an upper cover 12, a cover plate 13, a buckling piece 14, a positioning plate 15 and a twisted spring 16. A coin inlet 120, a cambered and penetrating slot 121 and a hole 127 are arranged in different positions at the same level of the upper cover 12. The plane of the upper cover 12 is arranged with a first protrusion 122, a second protrusion 123, a third protrusion 124, a fourth protrusion 125, and a fifth protrusion 126. The edge of the cover plate 13 has a curved slot 131 and a plurality of teeth 132. A cambered slot 131 is arranged on the cover plate 13 and a notch 134 is formed on a proper place on the edge thereof. Thereby, the cover plate 13 is arranged above the upper cover 12 to cause the convex plate 133 to protrude from the groove 121 of the upper cover 13. The third protrusion 124 and the fourth protrusion 125 pass through the slot 131. The second protrusion 123 and the fourth protrusion 125 confine the movement of the cover plate 13, a pivotal hole 143 is installed on a plate of the buckling piece 14. A plurality of teeth pieces 142 engageable to the teeth 132 of the cover plate are disposed at the edge thereof. A nose portion 144 is formed on the proper place of the buckling piece 14. A further block 141 is installed on the surface of the buckling piece 14, and the block 141 is combined to a lock (not shown). A concave portion 153 for being inserted by the nose portion 144 installed at the buckling piece 14 is formed on the edge of the positioning plate 15. A penetrated receiving hole 151 is installed on the positioning plate 15. The positioning plate 15 is installed on the plane of the upper cover 12, and the aforementioned fifth protrusion 126 passes through the receiving hole 151. Then a compressible spring 152 is placed into the receiving hole 151 so that two ends of the compressible spring 152 resist against the inner sides of the fifth protrusion 126 and the receiving hole 151. By the elasticity of the compressible spring 152, the concave portion 153 of the positioning plate 15 has a force to move to the nose portion 144 of the buckling piece 14. One end of the twisted spring 16 is wound as a ring, while another end thereof is formed as a hook. The ring covers the first protrusion 122, while the hook at another end buckles the notch 135 of the cover plate 13 so as to position the twisted spring 16. By the elastic force of the twisted spring 16, the cover plate 13 is retained to cover the coin inlet 120. When the aforementioned cover plate 13, buckling piece 14, positioning plate 15, and twisted spring 16 are all arranged within the upper cover 12, a sealing cover 11 seals the upper cover 12 (as shown in FIG. 2) in order to prevent these components to from dropping out and being destroyed.

Figure 4:
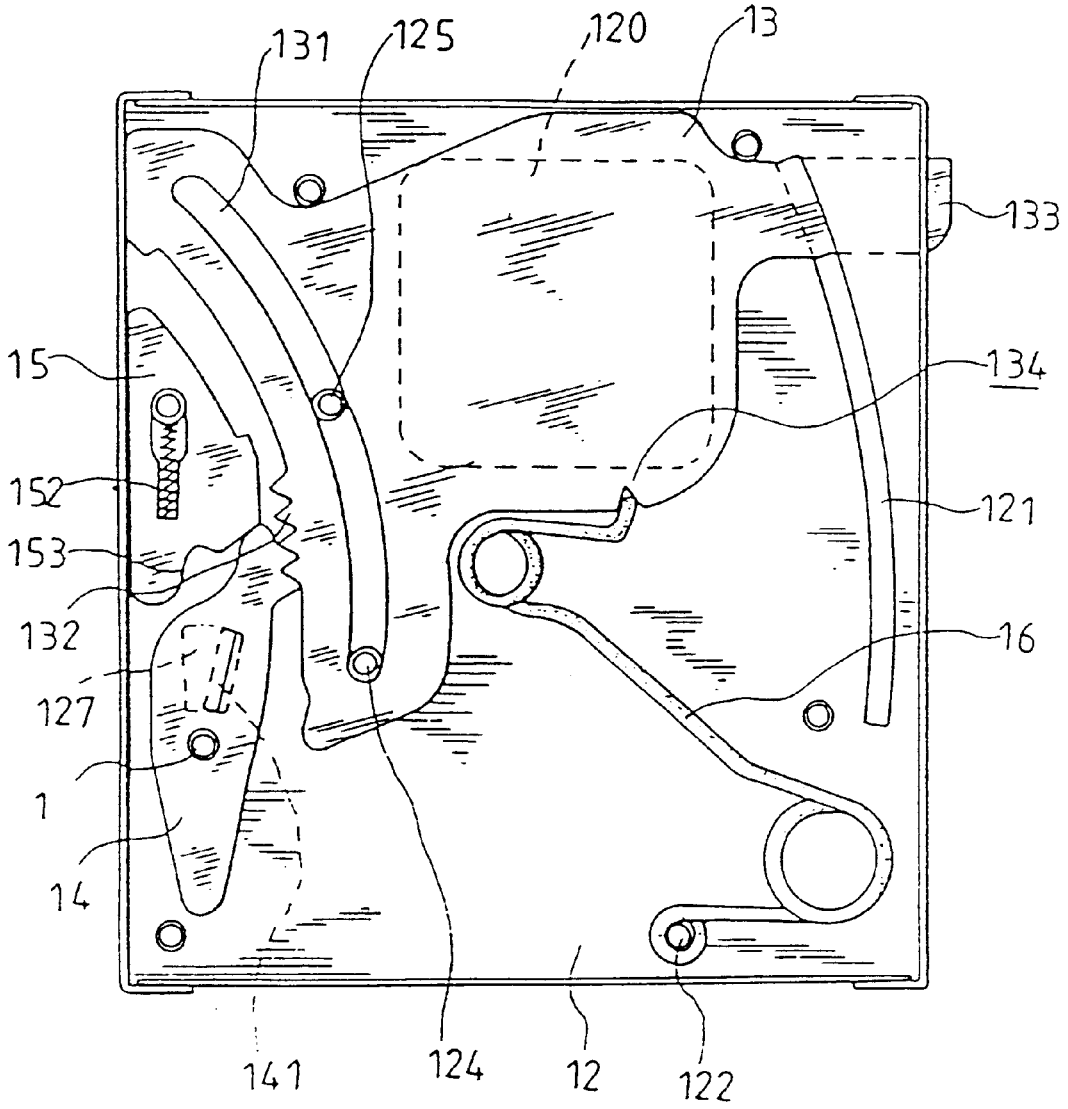
FIG. 4 is an elevation plane view of the coin collector cover according to the present invention, at this time the buckling piece is licked.
Figure 5:
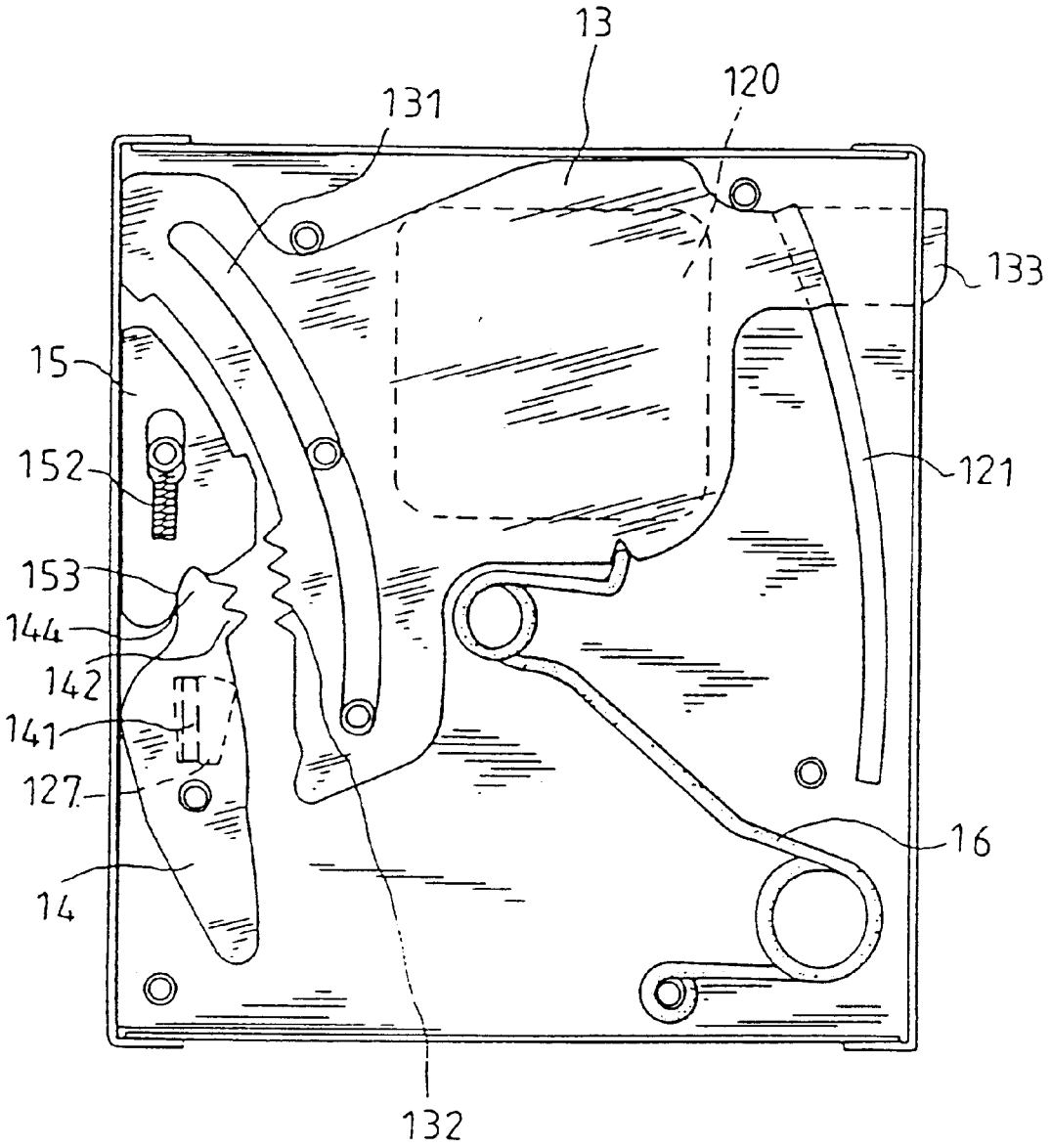
FIG. 5 shows the state that the buckling piece is separated from the buckling of the cover plate.
Figure 6:
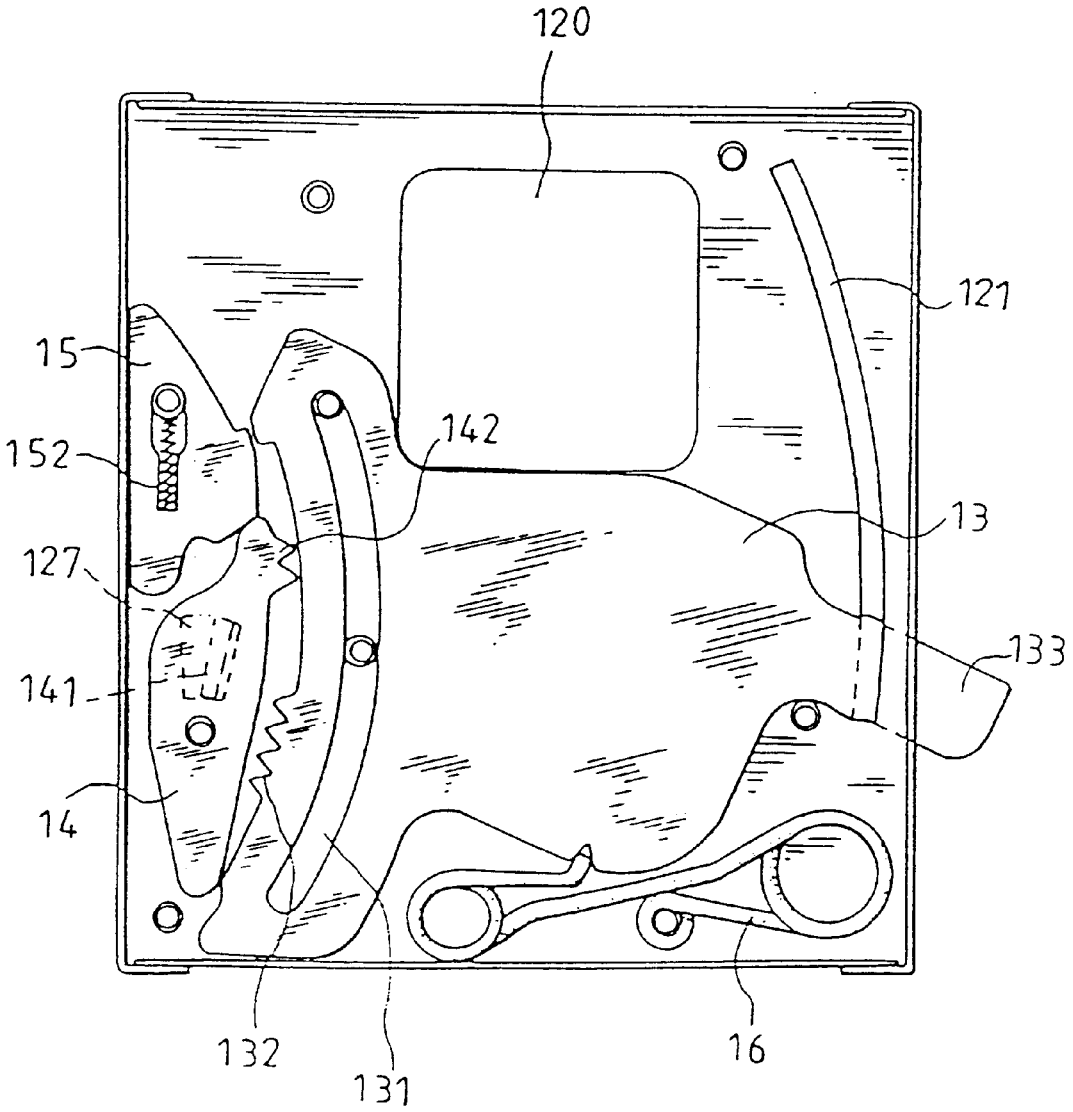
FIG. 6 shows the the cover plate is opened.
Figure 7:
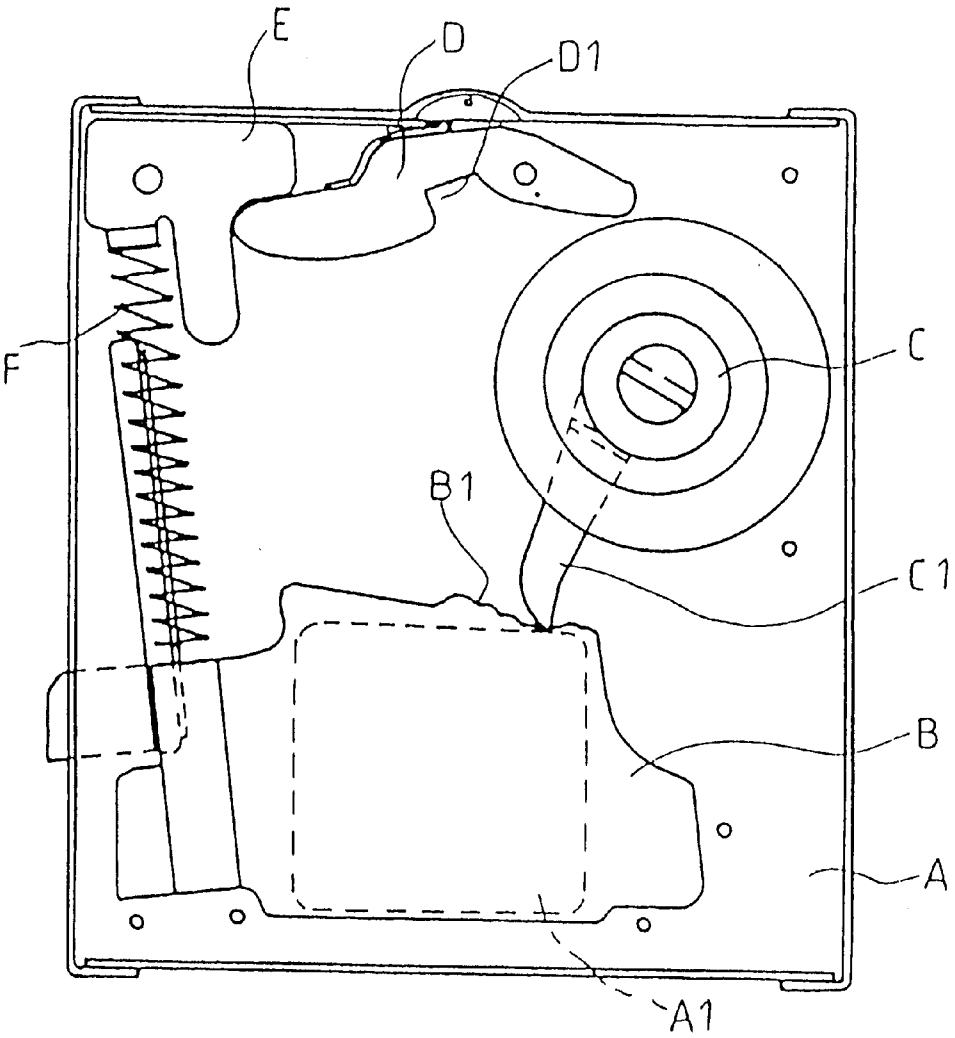
FIG. 7 (PRIOR ART)
FIG. 7 is elevation plan view of a prior art coin collector cover, wherein the cover plate is locked.
Figure 8:
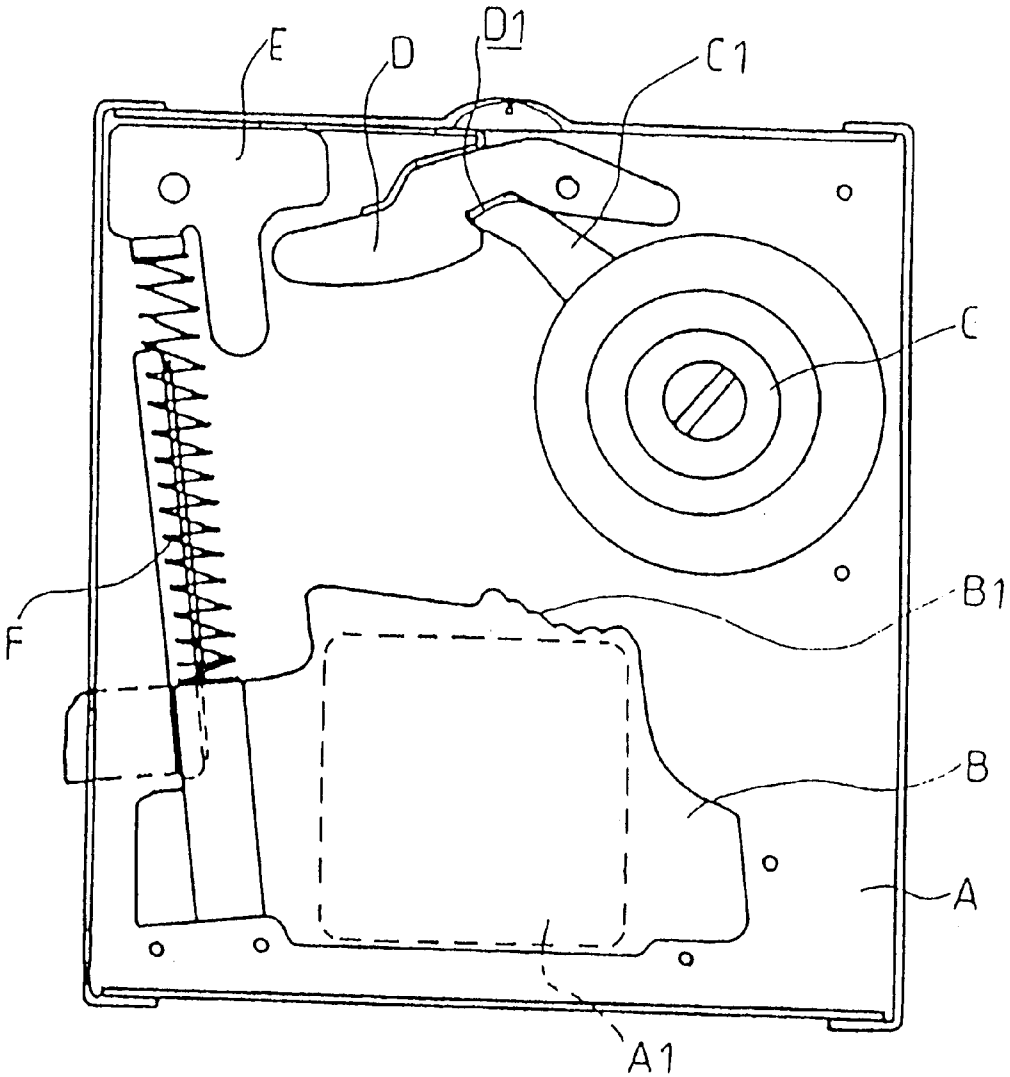
FIG. 8 (PRIOR ART)
FIG. 8 shows that the lock of FIG. 7 separates from the cover plate.
Figure 9:
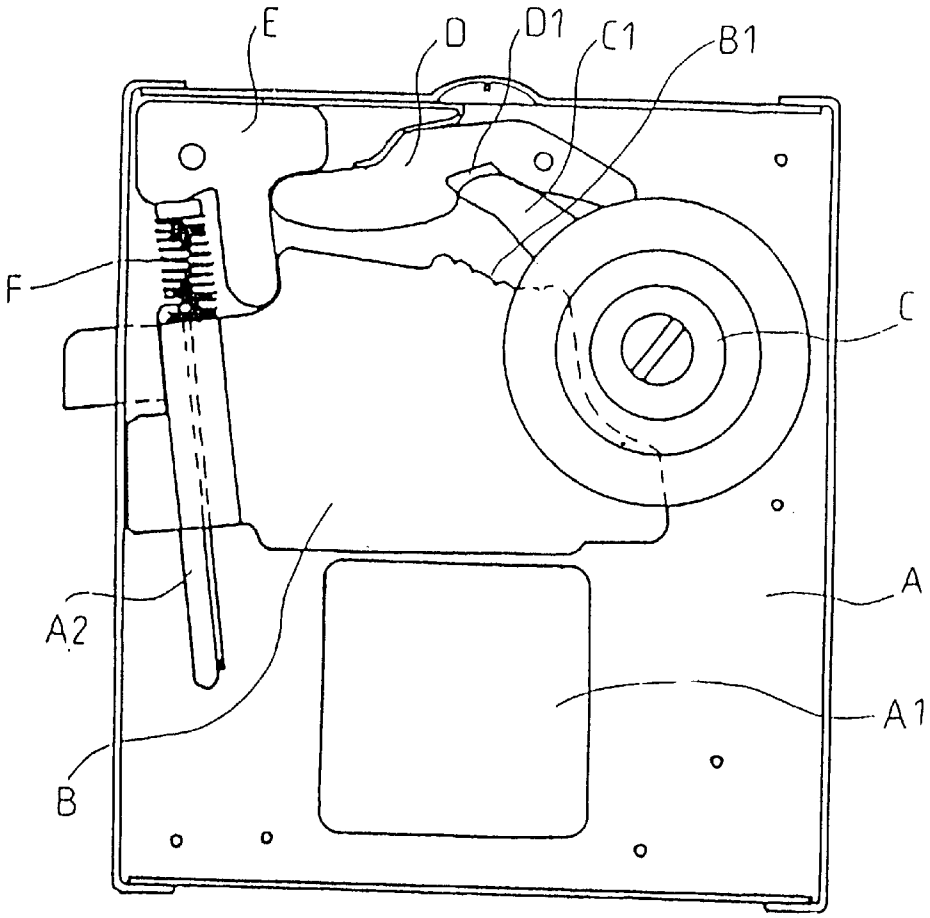
FIG. 9 (PRIOR ART)
FIG. 9 shows the cover plate of FIG. 8 is opened.

By the aforementioned structure of the present invention, when the aforesaid cover plate 13 covers the coin inlet 120 due to elastic force of the twisted spring 16, the lock combined to the nose portion 141 may be controlled so that the teeth 142 of the buckling piece 14 are engaged to the teeth 132 of the cover plate 13 so as to fix the cover plate 13 from being opened (as shown in FIG. 4). The nose portion 144 of the buckling piece 14 is separated with the concave portion of the positioning plate 15. When the lock is controlled so that the buckling piece 14 is displaced to cause the teeth piece to separate from the teeth 132 of the cover plate 13, and the nose portion 144 of the buckling piece 14 pushes away the positioning plate 15 and then is engaged into the concave portion of the positioning plate 15 in order to prevent that it returns (as shown in FIG. 5), then a finger serves to move the convex plate 133 so as to open the cover plate 13. Therefore, the coin inlet appears (as shown in FIG. 6) and the coins can be taken out. After the coin is taken out, the reverse procedure is preformed, thus, the cover plate is restored to the original place to cover the coin inlet 120. By the aforementioned structure of the present invention, since the structure for fixing a cover plate 13 is further away from the coin inlet 120, by the engagement of the plurality of teeth pieces 142 and teeth 132, the coin collector cover has a preferred strength to avoid being destroyed.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An improved structure of a coin collector cover, comprising:

an upper cover, a coin inlet and a slot being installed at different positions in the same plane of the upper cover;

a cover plate, a convex plate and a plurality of teeth being installed on the edge thereof, and a groove being formed on the cover plate, the cover plate arranged above the upper cover, and the convex plate protruding from the slot of the upper cover;

a buckling piece pivotally installed in the plane of the upper cover, a plurality of teeth pieces being disposed on the edge thereof for engaging the teeth of the cover plate, a nose portion being formed at the edge, and a buckling piece being installed with a block, and the block being combined with a lock;

a positioning plate, the edge of the positioning plate being installed with a concave portion for insertion by the nose portion of the buckling piece, and the positioning plate being installed in the plane of the upper cover, a compressible spring being installed between the positioning plate and the upper cover, by the elastic force of the compressible spring, the concave portion of the positioning plate being driven toward the nose portion of the buckling piece;

a twisted spring, two ends of which are applied to the cover plate and the upper cover, by the elastic force of the twisted spring, the cover plate having a force for retaining the cover plate to cover the coin inlet;

wherein, when the cover plate covers the coin inlet, the lock is controllable so that the teeth piece is engaged with the teeth of the cover plate so as to avoid the cover plate being opened, when the lock is controlled to cause the buckling piece to displace so that the teeth piece separates from the teeth of the cover plate, then the cover plate may be opened and the coin inlet appears.

2. The improved structure of a coin collector cover as claimed in claim 1, wherein the plane of the upper cover has protrusions so that the protrusions pass through the groove of the cover plate and thereby enter into the traveling length of the cover plate.

3. The improved structure of a coin collector cover as claimed in claim 1, wherein the positioning plate is arranged with a receiving hole, another protrusion is disposed in the plane of the upper cover so that the another protrusion passes through the receiving hole of the positioning plate, and then the compressible spring is placed into the receiving hole, so that the two ends of the compressible spring resist against inner ends of the another protrusion and the receiving hole.

* * * * *